US005279201A

United States Patent [19]

Jena et al.

[11] Patent Number: 5,279,201

[45] Date of Patent: Jan. 18, 1994

[54] PLASTIC CARTRIDGE AND PLASTIC CARTRIDGE-BELT MAGAZINE

[75] Inventors: Hans Jena, Furth; Kurt Ballreich, Nurnberg, both of Fed. Rep. of Germany

[73] Assignee: Dynamit Nobel Aktiengesellschaft, Troisdorf, Fed. Rep. of Germany

[21] Appl. No.: 915,604

[22] Filed: Jul. 21, 1992

[30] Foreign Application Priority Data

Jul. 24, 1991 [DE] Fed. Rep. of Germany ..... 4124490

[51] Int. Cl.[5] ..... C06D 5/00

[52] U.S. Cl. ..... 89/35.01; 102/466; 102/470; 102/531

[58] Field of Search ..... 89/35.01; 102/281, 466, 102/469, 470, 471, 530, 531; 227/9, 10, 11

[56] References Cited

U.S. PATENT DOCUMENTS

| | | | |
|---|---|---|---|
| 2,679,803 | 6/1954 | Lifquist | 102/441 |
| 3,435,765 | 4/1969 | Gawlick | 102/531 |
| 3,529,548 | 9/1970 | Gawlick et al. | 102/531 |
| 4,920,885 | 5/1990 | Bowman et al. | 102/281 |
| 5,036,746 | 8/1991 | Ehmig et al. | 89/35.01 |

FOREIGN PATENT DOCUMENTS

| | | |
|---|---|---|
| 0273777 | 7/1988 | European Pat. Off. . |
| 0377924 | 7/1990 | European Pat. Off. . |
| 0390738 | 10/1990 | European Pat. Off. . |

*Primary Examiner*—Stephen C. Bentley

*Attorney, Agent, or Firm*—Antonelli, Terry, Stout & Kraus

[57] ABSTRACT

A cartridge is made up of a synthetic resin case member and a synthetic resin lid. The case member contains a first receiving chamber for receiving an igniter charge and a second receiving chamber for the accommodation of a propellant charge. A synthetic resin ignition pin flexibly connected to the lid extends into the first receiving chamber. Upon the exertion of pressure by a striker on the rear end of the ignition pin, the pin is advanced further into the first receiving chamber, a pointed forward percussion end of this ignition pin acting on the igniter charge to ignite the charge. The igniter charge is accommodated in funnel shape in a conical depression of the first receiving chamber. The percussion end of the ignition pin, extending into the igniter charge, upon displacement, causes friction in the igniter charge material and thus generates frictional heat therein. Owing to this "broaching-type igniter principle", it is possible to obtain a reliable ignition of the igniter charge in spite of the use of synthetic resin, substantially softer as compared with metal, as the material forming the case member and forming the ignition pin.

34 Claims, 3 Drawing Sheets

FIG.8
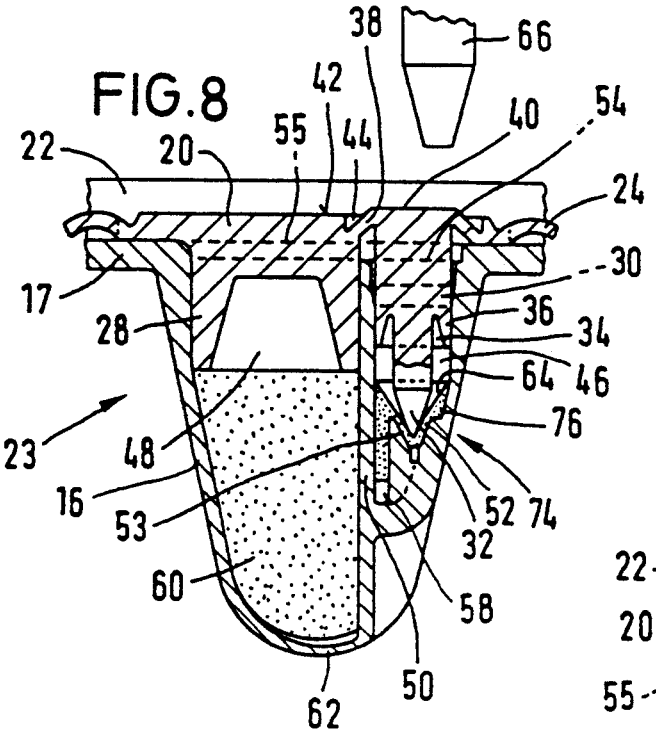
FIG.9
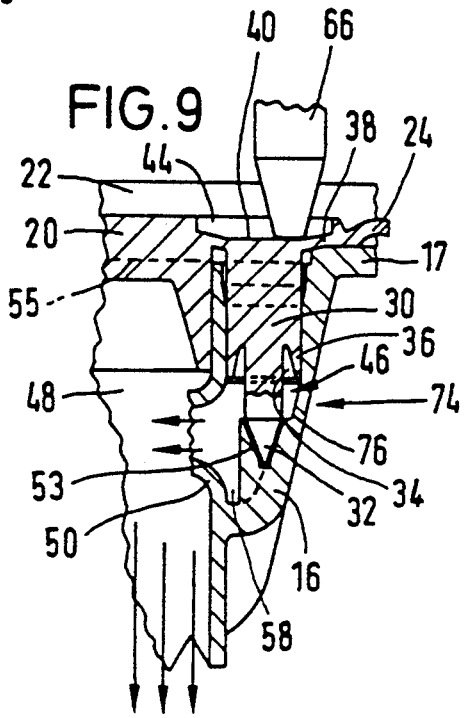
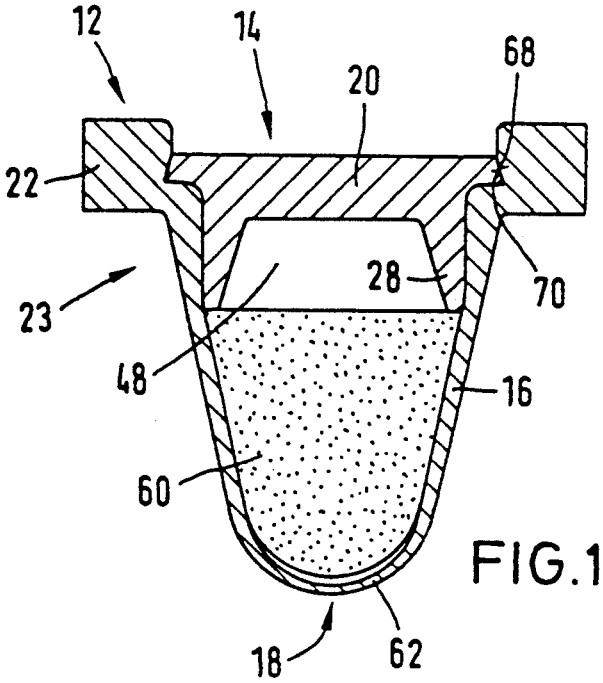
FIG.10

PLASTIC CARTRIDGE AND PLASTIC CARTRIDGE-BELT MAGAZINE

BACKGROUND OF THE INVENTION

This invention relates to a plastic cartridge made of a synthetic resin which is provided with a case member made of a synthetic resin and having an open end accommodating a propellant charge and an igniter charge for igniting the propellant charge upon the exertion of pressure on the igniter charge, and with a lid or cover made of a synthetic resin for sealing the open end of the case member. The invention furthermore concerns a cartridge belt magazine made of a synthetic resin with a case member strip made of a synthetic resin having several case members which are connected together, and with a sealing lid strip made of a synthetic resin having several joined-together sealing lid sections for closing off the case members.

Such (propellant) cartridges of plastic are utilized in firing devices, especially stud drivers of a great variety of types. In these devices, the cartridges are, in most cases, integrated into magazine strips (i.e. cartridge belt magazine). However, plastic cartridges can also be utilized in center-fired weapons. The advantages of plastic cartridges reside, in particular, in the relatively low costs for material and manufacture; for example, the cartridges can be produced by an injection-molding technique. A plastic cartridge and a plastic cartridge belt magazine of the type, heretofore described are known from EP 377,924 A1.

A certain problem in plastic cartridges consists in the initiation of the igniter charge by a striker. This is due, on the one hand, to the plasticity of the synthetic resin material damping the striker energy; for which reason the impulse with which the striker hits the lid or the case member must be enhanced. Secondly, the initiation of the igniter charge poses difficulties in plastic cartridges since the igniter charge is disposed between two layers of synthetic resin material. The deformation energy produced by the striker yields, under such conditions, an adequate temperature increase in the igniter charge only if the compression (force/surface area) and/or the deformation under this compression in the igniter charge is far higher than permitted by the synthetic resin. Sufficient compressions of the igniter charge can be realized only in case the igniter charge is accommodated between two metal parts, as is the case in metallic cartridges. Based on their material characteristics, igniter charges cannot be brought to any desired deformability (force/path). On account of the herein described properties of thermoplastic synthetic resins, in particular, the use of plastic cartridges in place of metallic cartridges in the stud drivers or center-fired weapons designed for metallic cartridges is not readily possible.

SUMMARY OF THE INVENTION

The invention is based on the object of providing a plastic cartridge and a plastic cartridge belt magazine of the type heretofore described which are usable without alteration of the device and/or of the striker mechanics in the conventional firing devices heretofore operating with metallic cartridges, optionally integrated into a charging strip.

In order to attain this object, the invention proposes to provide a plastic cartridge exhibiting a plastic open-ended case member or casing to accommodate a propellant charge as well as an igniter charge for the ignition of the propellant charge when pressure is exerted on the igniter charge, and a lid or cover for sealing the open end of the case member, wherein an ignition pin made of a synthetic resin, coupled with the lid, is arranged in a space defined by the case member and the lid to be longitudinally displaceable in the axial direction, and the ignition pin is movable, upon exertion of a pressure on the lid in the zone of its connection with the ignition pin, and acts (mechanically) on the igniter charge for ignition of the igniter charge. In accordance with the cartridge belt magazine of this invention, several such cartridges are integrated in a magazine strip.

The cartridge according to this invention is provided with an ignition pin which pin is advanced by a striker acting on the cartridge (lid) and acts during this step with its percussion end on the igniter charge to initiate the charge. The striker energy is thus converted into kinetic energy for the ignition pin; the pin, in turn, transmitting this energy by deformation of the igniter charge in order to ignite the igniter charge. The ignition pin thus functions as a transmission element for transmitting the striker energy to the igniter charge. A transmission of the energy of the striker through the cartridge wall, i.e. through the rigid lid, is purposely avoided according to this invention; rather, the cartridge of this invention is equipped with an element, namely the ignition pin, transforming the striker energy into kinetic energy. Damping of the striker energy by the synthetic resin material is thereby substantially reduced as compared with conventional plastic cartridges. Consequently, the plastic cartridge according to this invention can be triggered by means of the striker mechanics designed for metallic cartridges without having to effect any alterations on such devices.

In an advantageous further development of the invention, the provision is made that the percussion end of the ignition pin acting on the igniter charge is designed to terminate in a point, preferably of conical shape, and that the igniter charge is arranged in a preferably conical recess, indentation or depression, of the case member, corresponding to the form of the percussion end. The igniter charge exhibits a funnel shape in the zone where it is accommodated in the case member. Preferably, the surface of the conical recess extends in parallel to the outer surface of the percussion end of the ignition pin. Upon the impingement of the percussion end of the ignition pin onto the igniter charge, the percussion end exerts a pressure on the igniter charge.

However, at the same time, particles of the igniter charge are also caused to rub against one another so that the kinetic energy of the ignition pin is converted into friction energy in the igniter charge. On account of the pointed conical ignition pin and the funnel-shaped design or formation of the recess of the case member housing the igniter charge, a large friction path is thereby attained. The friction energy in the cartridge of this invention is thus produced primarily by an enlargement of the penetration depth of the percussion end of the ignition pin into the igniter charge. This aspect is enhanced by the herein-described structure of the ignition pin percussion end and the recess or indentation of the case member. Based on the "broaching or piercing initiation principle" according to this invention, it is possible to achieve adequate ignition of the propellant charge with a smaller quantity of igniter charge and with a reduced proportion of friction medium; as a consequence, the contamination of the device, especially erosion of the device, is substantially reduced as compared with the conventional cartridges.

A safe ignition can be achieved with the aid of the aforedescribed ignition principle wherein the pointed percussion end of the ignition pin penetrates into an igniter charge which latter is, so to speak, brought into the negative or counter-mating form with respect to the percussion end, and the thus-shaped funnel-like igniter charge is arranged in a recess or depression corresponding to the shape of the percussion end, in spite of the fact that the ignition material is disposed between two comparatively relatively soft plastic parts; this is possible because the ignition material is subjected to friction, and is thus heated up, during the relative movement of the two plastic parts. The friction energy is obtained by a tangential shift ("shear") of very small quantities of igniter charge (the layer thickness between the wall of the depression and the percussion end is small), this shift being produced by a spontaneously formed contact-pressure system (the pressure to which the layer of igniter charge is exposed becomes constantly higher on account of the conical surfaces of the percussion end and the depression). The friction heat is produced predominantly by an increase in the friction path with diminished pressure values.

Advantageously, a hollow-cone shape is imparted to the igniter charge when it is introduced into the conical depression of the plastic cartridge. The ignition pin dips with its pointed percussion end initially into the conical cavity of the thus-shaped igniter charge. No energy is required, in this connection, for displacing the material of the igniter charge toward all sides. Almost the entire energy of the ignition pin can be transformed into friction energy during the advancement of the ignition pin.

A further advantage of the plastic cartridge according to this invention resides in that the igniter charge is arranged at a relatively large distance from the opening of the case member and, respectively, from the lid of the cartridge. This produces special advantages in the preparation with mass-production tools; because the clean compression of the igniter charge pellet, preferably introduced as a wet charge, is now provided insofar as the cartridge (lid and/or case member) during mass processing will no longer be contaminated, or will be hardly contaminated, by igniter charge material oozing out during the compacting or compressing step, since the wet charge is introduced at great depth. The compacting of the thus—introduced igniter charge pellet is obtained solely by the axial advancing motion of the pellet-inserting pressure ram or plunger. The pressure ram likewise exhibits preferably a conical tip so that the aforedescribed hollow conical shape is imparted to the igniter charge during compacting or compressing of the igniter charge pellet.

The introduction of the ignition charge in the form of a wet charge has, as a first consideration safety advantages (freedom from dust). The "harder" constituents of the ignition charge (e.g. glass particles—as friction agent can, on introduction of the ignition charge into the cartridge, be pressed into this comparatively soft plastics material; on account of which the ignition charge is "firmly held" by the cartridge. This effect occurs with the cartridge according to the invention both on introduction of the ignition charge as wet charge and even on introduction as dry charge.

In an advantageous further development of the invention, the provision is made that the case member exhibits a first receiving chamber, corresponding in cross section to the ignition pin, for the accommodation of the igniter charge and of the ignition pin, and that the ignition pin is guided in a longitudinally displaceable fashion in the first receiving chamber. The first receiving chamber in this case exhibits preferably the shape of a blind hole bore. The conical recess for the (at least partial) accommodation of the igniter charge is here advantageously arranged at the end lying in opposition to the opening of the first receiving chamber. The ignition pin can be in sealing contact with its outer peripheral surface with the inner face of the first receiving chamber. The first receiving chamber as well as the ignition pin are preferably cylindrical. On account of the configuration of the first receiving chamber described herein, the igniter charge can be introduced into the cartridge in an especially simple way without encountering contaminations of the cartridge by the material of the igniter charge. The all-around guidance of the ignition pin in the first receiving chamber ensures a reliable guidance of the ignition pin without it being possible for the pin to jam.

In an advantageous further development of the invention, the provision is also made that the ignition pin, for being guided and longitudinally displaceable in the first receiving chamber, has an enlarged cross section in its zone facing the lid, this cross section being slightly smaller than or equal to the cross section of the first receiving chamber. The rearward portion of the ignition pin is thus enlarged in cross section and, in this zone, is in contact with the inner surface of the first receiving chamber. In the region of its percussion end, the ignition pin is made to be more slender and thus the pointed percussion end, upon penetration into the igniter charge, is surrounded on all sides by igniter charge material.

The ignition pin is preferably equipped with an integrally formed, continuously extending radial sealing lip for contacting the inner wall of the first receiving chamber. The sealing here of such a design that, with the igniter charge having been ignited, the lip is urged by the increased combustion gas pressure against the inner surface of the first receiving chamber. In this way, exiting of the combustion gases from the first mounting chamber into a direction that is not intended is prevented, and a return movement of the ignition pin is precluded by the contact pressure of the sealing lip against the inner surface of the receiving chamber.

In an advantageous further development of the invention, the provision is made that the lid has increased flexibility in the region of coupling with the ignition pin. This increased flexibility permits the advancing notion of the ignition pin when the striker acts on the cartridge. The ignition pin is preferably joined integrally to the lid, the connection being of such a nature that the ignition pin can be displaced in the axial direction while maintaining connection with the lid. Such a connection can be realized, for example, by a corresponding elasticity of the lid in the zone of the connection with the ignition pin. The provision is made advantageously in this arrangement that the lid is fashioned to be thinner, in the marginal zone around the end of the ignition pin connected thereto, than the lid in the remaining region. The material properties of the synthetic resin of the cartridge are such that the elasticity permits movement of the ignition pin while maintaining the mechanical connection with the cartridge.

Advantageously, the ignition pin is articulated to the lid at its end connected with the lid and facing away from the percussion end. This hinged connection can be effected, for example, by a film hinge or an annular diaphragm. All of the aforementioned connections have the advantage that the ignition pin can be produced in one piece with the lid as a plastic injection-molded part.

It is advantageous for the hinged connection of ignition pin and lid to be of such a design or construction that the synthetic resin material will not be subjected to an elongation while the ignition pin is advancing. This is realized by the feature that the lid or the case member ascends toward the ignition pin in the manner of a truncated cone in the annular zone around the ignition pin. In this arrangement, the ignition pin is, in its retracted position, which is assumed for being advanced upon the action exerted by the striker. As soon as the striker has acted on the ignition pin, the pin is further advanced into the case member, the annular zone at this point being of descending slope toward the end of the ignition pin, because when the ignition pin is in its advanced position, the outer surface of the lid projects beyond the end face of the ignition pin, i.e. the ignition pin is pressed in place. The articulated connection of ignition pin and lid has the advantage that the striker energy is not required for elongation of the plastic material, i.e. the striker impinges on the igniter charge with higher energy.

The provision is made in an advantageous embodiment of the invention that the first receiving chamber exhibits, besides its elongated first partial chamber corresponding in cross section to the ignition pin, a second partial chamber terminating into the first partial chamber in the conical region of the latter. The igniter charge, pressed into the first receiving chamber, preferably introduced as wet charge, is introduced during processing by the pressure ram, i.e. charge feed plunger, into the second partial chamber as well as into the conical zone of the first partial chamber of the first receiving chamber. The material of the igniter charge extends in this arrangement as a continuous layer joining the two partial chambers with each other. The substantially lower proportion of igniter charge material is located in the conical depression of the first partial chamber. Upon ignition of the igniter charge material in the first partial chamber, the igniter charge material located in the second partial chamber is consequently likewise ignited. Accordingly, merely a limited proportion and/or region of the igniter charge is heated by friction to above the spontaneous ignition temperature. On account of the low mass and/or low volume of the igniter charge material in the first partial chamber, the heat dissipation upon action by the ignition pin is likewise less, and for this reason the igniter charge will ignite earlier.

It is furthermore of advantage in the cartridge of this invention that igniter charge and propellant charge are housed in the case member entirely separately from each other. For this purpose, both charges are accommodated in separate spaces,, i.e. receiving chambers; the partition dividing the two chambers from each other is formed as a bursting wall which breaks open when the igniter charge is ignited so that the combustion gases pass to the propellant charge and ignite this charge. The bursting wall exhibits either a wall thickness ensuring bursting starting with the specific (combustion) gas pressure in the first receiving chamber, or corresponding predetermined rupturing zones.

Advantageously, the case member is provided with intentional breaking zones (stellate embossing) in the region of the (second) receiving chamber for the propellant charge in order to facilitate or bring about a bursting of the cartridge when the propellant charge has been ignited.

A basic problem in the use of synthetic resin for cartridges, (training) shells, and the like resides in the strength of the plastic material which is lower as compared with metal. In case the cartridge (shell) in the cartridge chamber or shell chamber is surrounded thereby over (almost) the entire surface, the relatively low strength of the plastic plays a subordinate role. However, problems are encountered in those firing devices operating with magazined cartridges, for example with cartridges integrated into a magazine strip. In these devices, e.g. stud drivers, there are regions in the cartridge chamber which partially do not encompass the cartridge, namely at those locations where the magazine strip is extended into the cartridge chamber and out of the chamber. In order to achieve an adequate stability and strength of the cartridge wall even at these sections of the cartridge located especially in the transitional zone from the lid to the case member, the provision is made according to a further advantageous embodiment of the invention that the lid has a relatively thick, continuously extending rim which projects into the interior of the case member and runs along the inside surface of the case member and/or of the receiving chamber for the propellant charge in contact with such surface. The lid, mounted, in turn, preferably in clamping fashion and/or in locking engagement in the case member, is secured against detachment when the propellant charge has been ignited by the shell chamber or cartridge chamber.

Preferably, the projecting rim of the lid, insertable in the opening of the case member, extends past the sealing lip of the ignition pin in the downward direction; this facilitates the placement of the lid.

As mentioned above, the cartridge of this invention can be used for firing devices with rim-type ignition as well as for firing devices with center-fired ignition. Depending on the type of device, the ignition pin is located at different positions of the lid, namely in the first case in the marginal zone, i.e. eccentrically, and in the second case in the central zone of the lid. The exact arrangement of the ignition pin depends on the position of the striker of the firing device. The eccentric arrangement of the igniter charge in the marginal zone is of advantage for the above-mentioned stability and/or strength of the cartridge in a firing device utilizing magazined cartridges, all of the ignition pins being arranged along the center line of the magazine belt. Thus, the ignition pin of one cartridge is disposed in the zone facing a neighboring cartridge. In this zone, the cartridge chamber does not encompass the case member completely. With the cartridge being ignited, the ignition pin has a strength-enhancing effect since it is located between the propellant charge and the "laterally open" region of the cartridge chamber.

The arrangement of the ignition pin in the rim zone of the cartridge moreover provides the advantage that the igniter charge is protected from the environment solely by the case member wall. This protection is sufficient as concerns mechanical actions or effects from the outside and moreover permits, when heat is acting on the cartridge, the harmless deflagration or burning of the igniter charge due to the thin-walled character of the case member in this zone; whereas the bursting wall between the igniter charge and the propellant charge prevents transmission of the ignition to the propellant charge. On account of the poor thermal conductivity of synthetic resin, the igniter charge withstands a brief action of heat (temperatures of above 1300° C. are uncritical anyway). With the preferred arrangement of the igniter charge on the longitudinal center axis of symmetry of the magazine strip, the igniter charge is especially well protected.

The above advantageous embodiments of the cartridge can also be utilized in the cartridge belt magazine according to this invention. The cartridge belt magazine of this invention is of an essentially bipartite shape and consists of several case members integrated into a plastic strip and of several sealing lid sections integrated into a sealing lid strip for closing off the open sides of the case members. In order to be able to compensate for differences between the spacings of the case members, on the one hand, and the spacings of the sealing lid sections,, on the other hand, the provision is made according to an advantageous further development of the cartridge belt magazine of this invention that the individual sealing lid sections are elastically joined (by means of flexible film hinges). In the region of its film hinges, the plastic sealing lid strip extends in arcuate shape, i.e. with a spacing to the case member strip. In this way, the spacing of neighboring sealing lid sections can be adapted to the spacing of associated neighboring case members.

In the zone of its film hinges, the sealing lid can be designed to be of the same width as the sealing lid sections; however, it is likewise possible to provide the lateral rims of the film hinges with marginal cutouts. In this way, (marginal or edge) relief holes or apertures are produced which are oriented toward the topside of the sealing lid strip. In case of a possible gas discharge from a cartridge between a sealing lid section and a case member, lifting off of the sealing lid section or even transmission of ignition to a neighboring cartridge is avoided, in that the gas can escape via the relief holes or apertures in the zone of the film hinge before reaching the adjacent cartridge.

The film hinges can, however, also be designed in the manner of flexible tongues or webs with interposed vacant spaces; the vacant spaces then constitute the relief holes or apertures.

The sealing lid strip is advantageously retained at the case member strip in a clamping and locking fashion. For this purpose, the case member strip advantageously exhibits on its two longitudinal sides thickened marginal or edge borders projecting beyond the surface of the topside equipped with the case member openings; these marginal borders or rim-like strips are essentially square or rectangular in cross section. The sealing lid strip is inserted with its external lateral edges in clamping and locking fashion to be in contact with the mutually facing inner surfaces of the marginal borders designed in the manner of flanges.

At one end of the plastic case member strip, the two marginal borders or strips are oriented laterally away from each other toward the outside. Between the marginal borders and the remaining portion of the case member strip, vacant spaces are formed at this end. The marginal strip ends, oriented away from each other, form a barrier preventing the introduction of the cartridge belt magazine in case of improper alignment.

The cartridge belt magazine according to this invention can be designed as an annular magazine as well as a linear belt magazine. Preferably, the receiving chambers for the igniter charges are arranged along the center line of the case member strip when viewing the strip in a top plan view.

BRIEF DESCRIPTION OF THE DRAWINGS

One embodiment of the cartridge belt magazine according to the invention will be described, in greater detail, with reference to the accompanying drawings, wherein:

FIG. 8 shows a cartridge of the cartridge belt magazine in a section along a longitudinal axis of symmetry of the belt magazine (line VIII—VIII of FIG. 2) with the striker not as yet acting on the cartridge;

FIG. 9 is a partial sectional view of the cartridge shown in FIG. 8 with the striker acting on the cartridge and with ignited igniter as well as propellant charges, and FIG. 10 is a section taken along line X—X of FIG. 2.

DETAILED DESCRIPTION OF THE INVENTION

Figure 1:
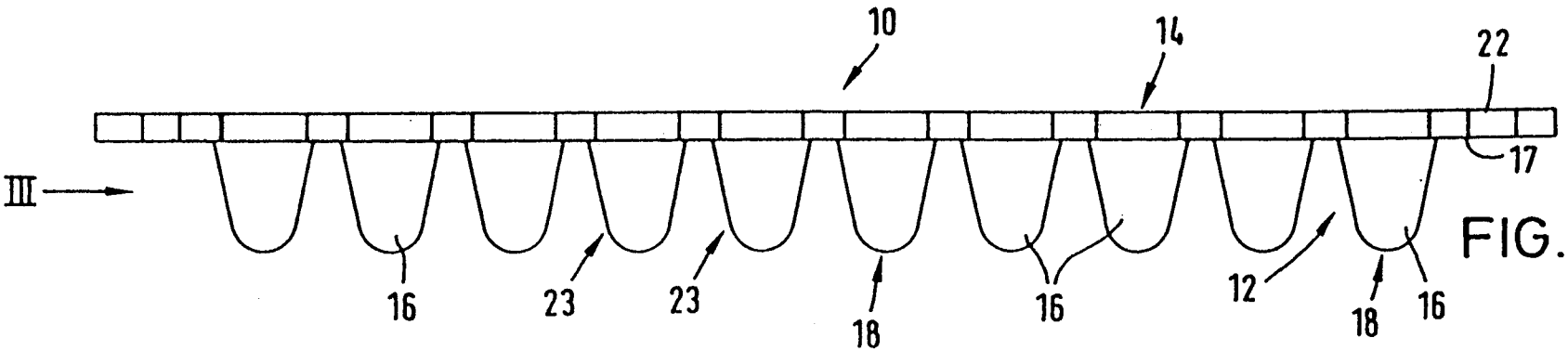
FIG. 1 shows a side view of a linear cartridge belt magazine with 10 cartridges in an assembled condition.
Figure 2:
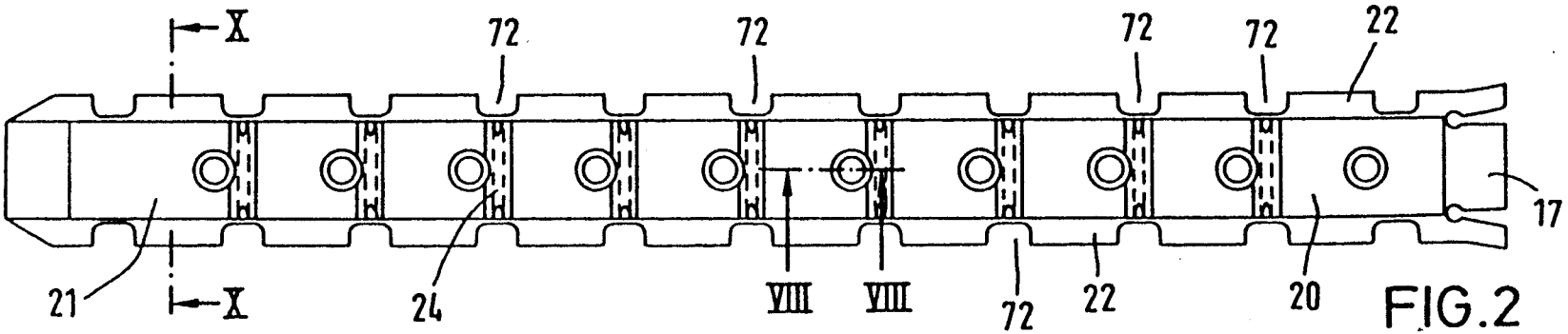
FIG. 2 is a plan view of the upper part of the cartridge belt magazine, showing the upper part of the sealing lid strip.
Figure 3:
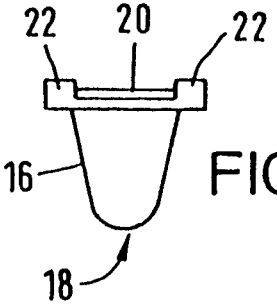
FIG. 3 is a front view of the cartridge belt magazine taken in the direction of arrow III of FIG. 1.

A cartridge belt magazine made of a synthetic resin is illustrated in FIGS. 1–3 in side, plan and sectional views. The belt magazine 10 consists of two plastic strips in locking connection or arrangement with each other; namely, a case member strip 12 and a sealing lid strip 14. The case member strip 12 comprises several case members 16 arranged in side-by-side relationship and joined via a plastic rim or flange portion 17 of the case member strip 12; each case member has a cup-like conical shape with a round bottom portion 18 facing away from the sealing lid strip 14. The case members 16, open toward the sealing lid strip 14, are sealed by sealing lid sections 20 which are hingedly joined and are integrated into a plastic belt 21 of the sealing lid strip 14. The case member strip 12 includes bead-like marginal borders 22 on its two longitudinal sides. These marginal borders 22 project in the upward direction beyond the sealing lid strip 14 and hold the strip between them in clamping and locking engagement. The case member strip 12 as well as the sealing lid strip 14 are produced in one piece as plastic injection-molded parts. The case members 16 form the cartridges 23 together with the sealing lid sections 20.

FIGS. 4 to 7 show the structure of the two strips 12, 14 of the belt magazine 10 in greater detail. The substantially rectangular sealing lid sections 20 are joined by way of diaphragms acting as film hinges. In the region of the film hinges 24, the sealing lid strip 14 has a reduced thickness. The film hinges 24 are provided with marginal cutouts or recesses 26 on their two exposed edges. The significance of these marginal cutouts 26 will be explained hereinafter.

The sealing lid section 20 (one of the sealing lid sections will be described in greater detail below as being representative for all of them) exhibits a closed collar rim 28 projecting downwardly at a right angle; this rim extends in the manner of a sickle. In the zone defined by the rim 28, the sealing lid section 20 has a greater thickness than in the remaining region (see FIG. 5). The rim 28 tapers conically toward its free end; the outer surface of the rim 28 extends perpendicularly to the topside of the sealing lid section 20.

A plastic ignition pin 30, projecting like the rim 28 downwardly from the sealing lid section 20, is integrally joined to the sealing lid section 20. The cylindrical ignition pin 30 has a larger diameter, in the section adjoining the end connected with the sealing lid section 20, than in the region of its free (percussion) end 32. This free end 32 of the ignition pin 30 is designed to be conical and tapers to a point. In the transitional zone of the section of Enlarged diameter to the section of reduced diameter of the ignition pin 30, the latter is provided with an axially open annular groove 34 so that a sealing lip 36 results integrally formed at the section of enlarged diameter.

Figure 4:
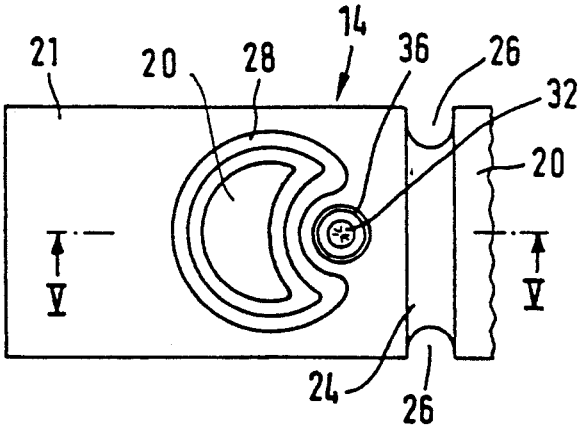
FIG. 4 is a plan view of a bottom of a sealing lid strip end (without a case member strip)
Figure 5:
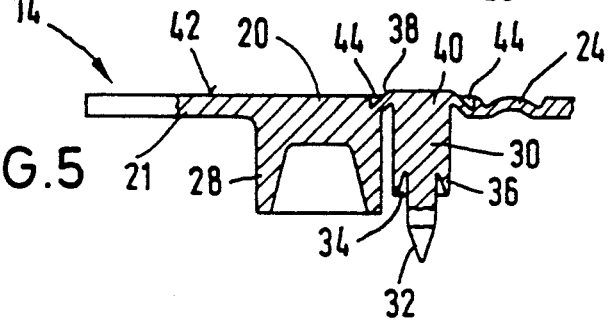
FIG. 5 is a section taken along line V—V of FIG. 4 of the sealing lid strip at one of its ends.

As can be seen from FIGS. 4 and 5, the ignition pin 30 is disposed beside the crescent-shaped rim 28 of the sealing lid section 20, the segment of the rim 28 facing the ignition pin partially surrounding the ignition pin 30 and extending in parallel to the circumference of the ignition pin 30 In the annular zone 38 about the end 40 of the ignition pin 30 connected with the sealing lid section 20, the sealing lid strip 14 has a reduced thickness; the annular zone 38 is designed in the manner of a diaphragm or a film hinge permitting an axial movement of the ignition pin 30 while maintaining the connection with the sealing lid strip 14 and, respectively, with the sealing lid section 20. The annular zone 38 extends in ascending fashion toward the end 40 of the ignition pin 30, the end face at the end 40 of the ignition pin 30 projecting beyond the outer surface 42 of the sealing lid when the ignition pin is in the retracted or initial position illustrated in FIG. 5. In this starting position, as will be described below, the striker of, for example, a stud driver acts on the end 40 of the ignition pin 30 in order to advance the ignition pin 30 axially into its advanced position wherein the percussion end 32 acts mechanically on an igniter charge housed in the case member 16. With the ignition pin 30 being in its advanced position, the end face of the ignition pin end 40 is located below the outer surface 42 of the sealing lid section, the annular zone 38 extending in descending fashion toward the end 40 of the ignition pin 30. As can he seen, in particular, with reference to FIG. 5, the sealing lid section 20 has a circular recess 44; in the region of the latter, the ignition pin 30 is connected with the sealing lid section 20 via the film hinge at annular zone 38.

Figure 6:
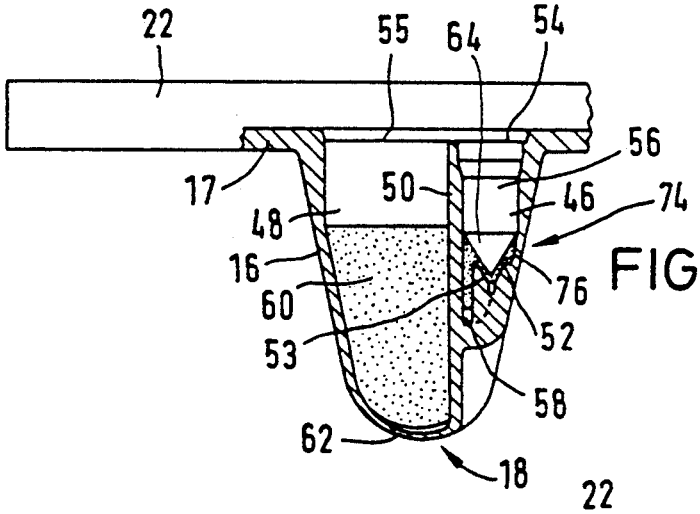
FIG. 6 is a longitudinal sectional view of a case member without a sealing lid.
Figure 7:
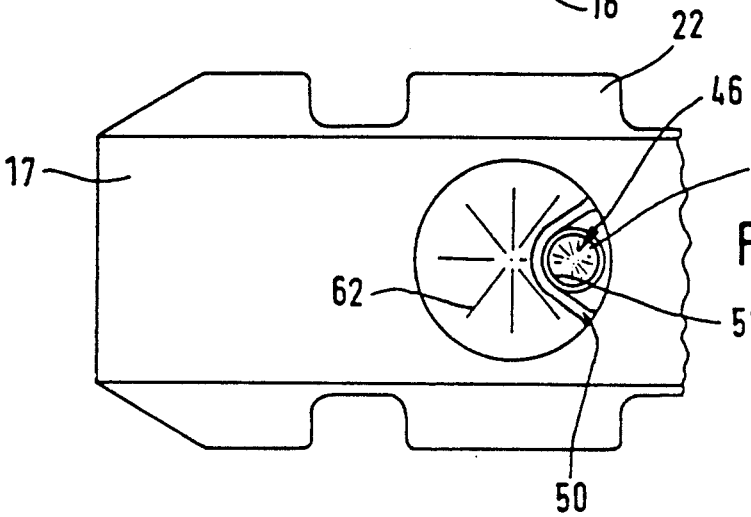
FIG. 7 is a top view of the case member strip at its end (without sealing lid strip)

The configuration of the case members of the case member strip 12 will be described hereinafter with reference to the case member 16 illustrated in FIGS. 6 and 7. The case member 16 exhibits a first receiving chamber 46 and a second receiving chamber 48. Both chambers 46, 48 are separated by a partition wall 50 and are otherwise defined by the outer wall of the case member 16. The first chamber 46 serves for receiving the ignition pin 30 and the igniter charge 52. The first chamber 46 accordingly comprises a partial chamber or space 56 designed essentially cylindrically in the manner of a blind hole bore, with the base of the bore being designed as a conical depression or zone 53. In the zone of its opening 54, the first chamber 46 has an enlarged diameter facilitating the introduction of the ignition pin 30 when placing the sealing lid strip 14 onto the case member strip 12. The second chamber 48 has an opening 55.

Besides the essentially cylindrical first partial chamber 56, described above, the first chamber 46 also contains a second partial chamber or space 58 opening into the first partial space in the zone of the conical end 53 of the latter. Both component spaces are connected by way of the conical wall of the first partial chamber. The second partial chamber 58 serves for the accommodation of the igniter charge 52 which latter, however, is also housed, in part, in the first partial chamber 56, namely in the region of its conical end 53. The second partial chamber 58 is separated from the second receiving chamber 48 by the partition wall 50.

The second chamber 48 serves for receiving the propellant charge 60 which is ignited by the combustion gases produced when the igniter charge 52 is ignited. The second chamber 48 extends into the region of the bottom 18 of the case member 16 where the case member 16 exhibits on its inside a stellate embossing, indicated at 62 in FIG. 7, for the production of intentional breaking zones.

With reference to the cross-sectional views of an assembled cartridge, illustrated in FIGS. 8 and 9, the mode of operation of this cartridge 23 will be described in greater detail hereinafter.

In the assembled condition of the belt magazine 10 wherein the sealing lid strip 14 has been placed onto the case member strip 12, the rim 28 of the sealing lid section 20 is inserted into the second chamber 48, its outer surface being in close contact with the inner surface of the case member 16, defining the second chamber 48 in the zone of its opening 55, and with the partition wall 50. In this condition, the ignition pin 30 dips into the first partial chamber 56 of the first chamber 46, its percussion end 32 being located at a spacing with respect to the conical depression 53 at the end of the first partial space 56. The ignition pin 30 is initially in its retracted position wherein the end face of its end 40, joined to the sealing lid section 20, projects past the surface 42 of the sealing lid section 20. While the propellant charge 60 completely fills the region of the second chamber 48 underneath the sealing lid section rim 28, the igniter charge 52 has a cavity 64 on its side facing the percussion end 32. This cavity is produced by the manner of introducing the igniter charge into the chamber 46 during processing. The igniter charge 52 is inserted as a wet-charge pellet first of all in the first partial chamber 56 of the first chamber 46. Subsequently, the wet-charge pellet is pressed with the aid of a feed ram having a conical end up to far into the chamber 46, the material of the igniter charge 52 being pressed into the second partial space of the first chamber 46 as well as into the conical depression of the first partial space 56. On account of the conical design of the end of the ram, the material of the igniter charge 52 present in the first partial chamber 56 is shaped as illustrated in FIGS. 6 and 8, being essentially like a hollow cone. The conical end 53 of the first partial chamber 56 of the first chamber 46 is thus covered with igniter charge material in a relatively small layer thickness. During the drying of the igniter charge 52, introduced as a wet charge, this igniter charge retains its configuration.

For triggering the cartridge, the striker indicated at 66 in FIGS. 8 and 9 acts on the end 40 of the ignition pin 30, connected with the sealing lid section 20, whereupon this ignition pin advances axially in the longitudinal direction within the first chamber. During this step, the conical percussion tip 32 acts on the igniter charge layer at the conical end 53 of the first chamber 46. Friction heat is thus produced in the igniter charge layer, this heat finally leading to ignition of the igniter charge material. The friction heat is obtained to a greatly predominant extent due to the relatively long friction path of the percussion end 32 in the layer of igniter charge; the pressure with which the percussion end 32 of the ignition pin 30 acts on the igniter material plays rather a subordinate part. The selection of the material of the case member 16 (a synthetic resin) enhances the ignition of the igniter charge 52 since the friction heat produced in the latter is hardly dissipated on account of the relatively poor heat conductivity of plastic. As soon as the igniter charge 52 has been ignited, combustion gases evolve. The rapidly rising gas pressure in the first chamber urges the sealing lip 36 of the ignition pin 30 against the inner wall of the first chamber and thus takes care of a gas-tight sealing of the first chamber 46 toward the outside and of a high contact pressure by means of which the ignition pin 30 is secured against shifting in the direction toward its retraction position. The rise in gas pressure finally leads to a bursting of the partition wall 50 which insofar (also) takes over the function of a bursting wall. The hot combustion gases flowing from the first chamber 46 into the second chamber 48 ignite the propellant charge 60 whereupon the case member 16 tears open in the bottom zone 18 and releases the gaseous stream. The situation described herein is illustrated in FIG. 9.

As can be seen with reference to FIGS. 8 and 9, the percussion end 32 of the ignition pin 30 in its retracted position (FIG. 8) is located at a distance with respect to the conical depression 53 in the first chamber 46 while the conical surface of the percussion end 32, with the ignition pin 30 being in its advanced position (FIG. 9), is in contact with the conical surface of the depression of the first chamber 46. In order to be able to move the ignition pin 30 forwards in the axial direction for abutting against the conical depression 53 of the first chamber 46, the plane in which the opening 54 of the first chamber 46 lies is spaced from the annular region 38 joining the ignition pin 30 to the lid section 20. With the ignition pin 30 being in its advanced position, the annular region 38 partly extends around the end 40 of the ignition pin 30 in this free space above the opening 54 of the first chamber 46 (see FIG. 9).

FIG. 10 illustrates the clamping and locking connection of the case member strip 12 and the sealing lid strip 14. The rim 28 of each sealing lid section 20 is in clamping engagement with the inner surface of each case member 16, defining the second receiving chamber 48. The two rims 22 or marginal borders of the case member strip 12 project beyond the topside of the sealing lid strip 14 and have on their mutually facing inner surfaces undercut recesses 68 into which lock the correspondingly formed lateral edges 70 of the sealing lid strip 14.

As can be seen with reference to FIG. 2, the rims 22 of the case member strip 12 exhibit outer marginal cutouts or recesses 72 located at the level of the film hinges 24 joining the individual sealing lid sections 20. The cutouts 72 do not extend over the entire thickness of the rims 22. The cutouts 72 prescribe the extent by which the belt magazine 10 must be advanced in order to load the next cartridge 23.

Both rims 22 are separated, at one end of the case member strip 12, from the remaining part of the strip, and extend away from each other toward the outside. The width of the case member strip 12 at this end is thus larger than in the remaining region of the case member strip. Thereby, an improper insertion of the belt magazine 10 in the firing device is prevented.

The belt magazine 10 and/or the cartridges 23 integrated into this magazine, as illustrated in the figures, exhibit the features and properties set out hereinafter. The entire belt magazine 10 consists solely of two injection-molded plastic parts, namely the case member strip 12 and the sealing lid strip 14. Correspondingly, each cartridge 23 consists solely of the plastic case member 16 and the plastic sealing lid section 20. On account of the-conical percussion end 32 of the ignition pin 30 and the conical depression 53 wherein a portion of the igniter charge 52 is housed, the friction energy required for ignition of the igniter charge 52 is produced during the action of the percussion end 32 on the igniter charge by a relatively large friction path. Based on this broaching or piercing ignition principle, the igniter charge 52 can be safely ignited at correspondingly low ignition power in spite of its arrangement between two relatively soft plastic parts, namely the ignition pin percussion end 32 and the wall of the conical depression 53 in the first holding chamber 46. The ignition pin 30 is joined integrally with the sealing lid sections.

The ignition charge is introduced relatively deeply into the case member 16 so that fouling in the region of the case member opening 54, 55 and therefore leaks in the sealing lid sections do not occur. The ignition charge 52 may be accommodated by mere actual introduction of a charge pellet into the first receiving chamber 46. This axial introduction can be realized simply from the point of view of manufacture and accordingly at favorable cost. With the tool for this it is a question, for example, of an axially displaceable plunger which presses the charge pellet axially into the first receiving chamber 46 up to the conical cavity therein. Several such plungers can operation simultaneously in order to charge a number of cartridges with the ignition charges. This is simpler, quicker and more favorable as to cost than the hitherto usual introduction of the ignition charges by "smearing" the ignition charge in the furrows of casings or cartridges with the assistance of a rotating screw-driver type of tool. The lateral arrangement of the ignition charge may give rise in the case of combustion or heating, to ignition of the ignition charge, without danger, taking place outside the firing device without an over ignition to the propellant charge composition taking place.

The rim 28 of the sealing lid section 20, acting as a sealing lip, is securely pressed against the case member inside wall by the gas pressure when the propellant charge has been ignited, so that no gas can exit via the sealing lid section 20, and the ignition pin 30 is held in fixedly clamped engagement. By the choice of a suitable plastic, for example polycarbonate, and by a correspondingly thick and high design or construction of the rim 28 of the sealing lid sections 20, a lateral bursting of the cartridge 23 in the upper zone of the case members, not surrounded in part by the cartridge chamber, is most extensively prevented or precluded. The ignition pin 30 is held fixedly clamped even with the propellant charge 60 being ignited, namely by the contact pressure forces of the rim 28 of the sealing lid section, acting via the partition wall 50 on the ignition pin 30.

If combustion gases should flow away via the sealing lid section 20 after all, their transmission to an adjacent cartridge is prevented by the marginal cutouts 26 of the film hinges 24 of the sealing lid strip 14. These marginal cutouts 26 act, in the above-described instance, as relief bores or openings, through which the cases can exit before reaching the neighboring cartridge 23.

The case member strips and sealing lid strips produced in the manner of belts can be injection-molded in a grid so that multiple handling during production is made possible with simplest means. Several case member strips and several sealing lid strips are thus manufactured separately of one another. Thereupon, the case members, arranged in a grid, are equipped with the igniter charges and the propellant charges. Subsequently, the sealing lid section grid is placed thereon. Introduction of the ignition pins into the openings 54 of the case members is facilitated in this arrangement by the first mounting chambers enlarged in the opening zone. Since the rims 28 of the sealing lid sections 20 project downwardly past the sealing lips 36 of the ignition pins 30 when the latter are in their retracted position, the rims 28 already dip into the case members before the ignition pin, in case of a careless placement of the sealing lid sections, can be obliquely pressed in place. Even an ignition pin 30 that does not extend coaxially to the first holding chamber 46 can consequently be introduced reliably and without problems into the first holding chamber 46 during the production of the belt magazines.

During operation of the cartridge 3, the amount of igniter charge arranged in funnel shape in the first mounting chamber 46 and the conical depression 53 force the ignition pin 30, even in case of a deformation of the pin, into the "ignition center" and thus ensure its correct functioning.

What is claimed is:

1. A cartridge of a synthetic resin comprising a case member having an open end and being made of plastic for accommodating a propellant charge and an igniter charge, said igniter charge igniting the propellant charge upon the application of a pressure to the igniter charger, and a lid made of plastic for sealing the open end of the case member; said cartridge further comprising a chamber defined by the case member and the lid, and an ignition pin of plastic coupled with the lid arranged to be longitudinally displaceable in an axial direction within said chamber;

the ignition pin being moved upon the application of a pressure to the lid in a zone connecting with the ignition pin, the ignition pin acting on the igniter charge to effect ignition of the igniter charge and a percussion end of the ignition pin acting on the igniter charge being shaped to taper to a point in the manner of a cone, and the igniter charge being arranged in a conical recess within the chamber of the case member.

2. A cartridge according to claim 1, wherein the case member includes a first receiving chamber, corresponding in cross section to the ignition pin, for receiving the igniter charge and the ignition pin, the ignition pin being guided to be longitudinally displaceable in the first receiving chamber.

3. A cartridge of a synthetic resin comprising a case member having an open end and being made of plastic for accommodating a propellant charge and an igniter charge, said igniter charge igniting the propellant charge upon the application of a pressure to the igniter charge, and a lid made of plastic for sealing the open end of the case member; said cartridge further comprising a first receiving chamber defined by the case member and the lid, and an ignition pin of plastic coupled with the lid arranged to be longitudinally displaceable in an axial direction within said chamber; said first receiving chamber corresponding in cross section to the ignition pin, for receiving the igniter charge and the ignition pin;

the ignition pin being moved upon the application of a pressure to the lid in a zone connecting with the ignition pin, the ignition pin acting on the igniter charge to effect ignition of the igniter charge; the first receiving chamber being shaped to taper pointedly to form a conical end zone at an end located in opposition to an opening of the first receiving chamber.

4. A cartridge according to claim 3, wherein the first receiving chamber is arranged eccentrically in a marginal zone of the case member.

5. A cartridge according to claim 4, wherein the case member is constructed to be thin-walled in a zone of an end of the first receiving chamber provided with the igniter charge.

6. A cartridge of a synthetic resin comprising a case member having an open end and being made of plastic for accommodating a propellant charge and an igniter charge, said igniter charge igniting the propellant charge upon the application of a pressure to the igniter charge, and a lid made of plastic for sealing the open end of the case member; said cartridge further comprising a first receiving chamber defined by the case member and the lid, and an ignition pin of plastic coupled with the lid arranged to be longitudinally displaceable in an axial direction within said chamber; said first receiving chamber, corresponding in cross section to the ignition pin, for receiving the igniter charge and the ignition pin;

the ignition pin being moved upon the application of a pressure to the lid in a zone connecting with the ignition pin, the ignition pin acting on the igniter charge to effect ignition of the igniter charge and the ignition pin having an integrally formed, continuously extending sealing lip for contacting and pressing against an inner surface of the first receiving chamber when the igniter charge has been ignited.

7. A cartridge according to claim 6, wherein the lid has a region of increased flexibility at which the ignition pin adjoins the lid.

8. A cartridge of a synthetic resin comprising a case member having an open end and being made of plastic for accommodating a propellant charge and an igniter charge, said igniter charge igniting the propellant charge upon the application of a pressure to the igniter charge, and a lid made of plastic for sealing the open end of the case member; said cartridge further comprising a first receiving chamber defined by the case member and the lid, and an ignition pin of plastic coupled with the lid arranged to be longitudinally displaceable in an axial direction within said chamber; said first receiving chamber, corresponding in cross section to the ignition pin, for receiving the igniter charge and the ignition pin;

the ignition pin being moved upon the application of a pressure to the lid in a zone connecting with the ignition pin, the ignition pin acting on the igniter charge to effect ignition of the igniter charge; the first receiving chamber being shaped to taper pointedly to form a conical end zone at an end located in opposition to an opening of the receiving chamber and the ignition pin having an integrally formed, continuously extending sealing lip for contacting and pressing against an inner surface of the first receiving chamber when the igniter charge has been ignited.

9. A cartridge of a synthetic resin comprising a case member having an open end and being made of plastic for accommodating a propellant charge and an igniter charge, said igniter charge igniting the propellant charge upon the application of a pressure to the igniter charge, and a lid made of plastic for sealing the open end of the case member; said cartridge further comprising a first receiving chamber defined by the case member and the lid, and an ignition pin of plastic coupled with the lid arranged to be longitudinally displaceable in an axial direction within said chamber; said first receiving chamber, corresponding in cross section to the ignition pin, for receiving the igniter charge and the ignition pin;

the ignition pin being moved upon the application of a pressure to the lid in a zone connecting with the ignition pin, the ignition pin acting on the igniter charge to effect ignition of the igniter charge; said ignition pin having at its section facing the lid, an enlarged cross section slightly smaller than or equal to the cross section of the first receiving chamber for effecting longitudinal displaceable guidance into the receiving chamber and the ignition pin having an integrally formed, continuously extending sealing lip for contacting and pressing against an inner surface of the first receiving chamber when the igniter charge has been ignited.

10. A cartridge of a synthetic resin comprising a case member having an open end and being made of plastic for accommodating a propellant charge and an igniter charge, said igniter charge igniting the propellant charge upon the application of a pressure to the igniter charge, and a lid made of plastic for sealing the open end of the case member; said cartridge further comprising a chamber defined by the case member and the lid, and an ignition pin of plastic coupled with the lid arranged to be longitudinally displaceable in an axial direction within said chamber;

the ignition pin being moved upon the application of a pressure to the lid in a zone connecting with the ignition pin, the ignition pin acting on the igniter charge to effect ignition of the igniter charge; the ignition pin being integrally connected with the lid in such a way that the pin is displaceable while maintaining a connection with the lid and an end of the ignition pin near the lid being connected by means of a continuously extending film hinge to the lid, the lid having a reduced thickness in an annular zone around the ignition pin which forms said hinge pin and, with the ignition pin not yet being under pressure, the lid extends, in the annular zone around the ignition pin, in the manner of a truncated cone, ascending toward the ignition pin.

11. A cartridge according to claim 10, wherein an end face of the ignition pin at the end of the pin connected with the lid projects, with the ignition pin not being under pressure, beyond an outer surface of the lid.

12. A cartridge of a synthetic resin comprising a case member having an open end and being made of plastic for accommodating a propellant charge and an igniter charge, said igniter charge igniting the propellant charge upon the application of a pressure to the igniter charge, and a lid made of plastic for sealing the open end of the case member; said cartridge further comprising a first receiving chamber defined by the case member and the lid, and an ignition pin of plastic coupled with the lid arranged to be longitudinally displaceable in an axial direction within said chamber; said first receiving chamber corresponding in cross section to the ignition pin, for receiving the igniter charge and the ignition pin;

the ignition pin being moved upon the application of a pressure to the lid in a zone connecting with the ignition pin, the ignition pin acting on the igniter charge to effect ignition of the igniter charge; the first receiving chamber including a partial space terminating in a region of a conical end of said chamber, and the igniter charge being introduced into this partial space and into a conical end zone of the first receiving chamber.

13. A cartridge according to claim 12, wherein a second receiving chamber for the propellant charge is formed in the case member adjacent to the first receiving chamber for the igniter charge and both receiving chambers are separated from each other by a bursting wall, said bursting wall being constructed to burst open when the igniter charge has been ignited so that combustion gases from the igniter charge pass into the propellant charge and ignite the latter.

14. A cartridge according to claim 13, wherein the case member is weakened at an end lying in opposition to the lid in a region of a wall defining the receiving chamber for the propellant charge, said weakened end bursting open when the propellant charge has been ignited.

15. A cartridge according to claim 13, wherein the lid has a collar rim projecting inwardly into an opening in the case member and extending around said opening, said collar rim being in contact with an inner surface of the case member defining the receiving chamber for the propellant charge.

16. A cartridge according to claim 15, wherein the collar rim of the lid, with the ignition pin being in its retracted position prior to pressure exertion, projects beyond a sealing lip of the pin in a downward direction.

17. A cartridge of a synthetic resin comprising a case member having an open end and being made of plastic for accommodating a propellant charge and an igniter charge, said igniter charge igniting the propellant charge upon the application of a pressure to the igniter charge, and a lid made of plastic for sealing the open end of the case member; said cartridge further comprising a first receiving chamber defined by the case member and the lid, and an ignition pin of plastic coupled with the lid arranged to be longitudinally displaceable in an axial direction within said chamber;

the ignition pin being moved upon the application of a pressure to the lid in a zone connecting with the ignition pin, the ignition pin acting on the igniter charge to effect ignition of the igniter charge; the ignition pin being integrally connected with the lid in such a way that the pin is displaceable in an axial direction while maintaining a connection with the lid and the first receiving chamber including a partial space terminating in a region of a conical end of said chamber, and the igniter charge being introduced into this partial space and into a conical end zone of the first receiving chamber.

18. A cartridge of a synthetic resin comprising a case member having an open end and being made of plastic for accommodating a propellant charge and an igniter charge, said igniter charge igniting the propellant charge upon the application of a pressure to the igniter charge, and a lid made of plastic for sealing the open end of the case member; said cartridge further comprising a chamber defined by the case member and the lid, and an ignition pin of plastic coupled with the lid arranged to be longitudinally displaceable in an axial direction within said chamber;

the ignition pin being moved upon the application of a pressure to the lid in a zone connecting with the ignition pin, the ignition pin acting on the igniter charge to effect ignition of the igniter charge; the ignition pin being integrally connected with the lid in such a way that the pin is displaceable while maintaining a connection with the lid and an end of the ignition pin near the lid being connected by means of a continuously extending film hinge to the lid, the lid having a reduced thickness in an annular zone around the ignition pin which forms said film hinge and, with the ignition pin not yet being under pressure, the lid extends, in the annular zone around the ignition pin, in the manner of a truncated cone, ascending toward the ignition pin; the first receiving chamber including a partial space terminating in a region of a conical end of said chamber, and the igniter charge being introduced into this partial space and into a conical end zone of the first receiving chamber.

19. A cartridge belt magazine made of a synthetic resin, which comprises:

a plastic case member strip comprising several joined-together, open-ended case members for accommodating a propellant charge and an igniter charge for igniting the propellant charge;

a plastic sealing lid strip comprising several joined-together sealing lid sections for sealing the open ends of the case members, respectively, so that the case member strip and the sealing lid strip are coupled with each other; said magazine further comprising:

a plurality of ignition pins movable in an axial direction and integrally joined to a sealing lid section; and in each case member, a first receiving chamber is formed for accommodating an ignition pin and an igniter charge, each of said ignition pins being guided to be longitudinally displaceable in the axial direction in an associated first receiving chamber, and acting, when placed under pressure, on an igniter charge in order to ignite the igniter charge; the first receiving chambers each comprise a bore with a pointedly and conically tapering end, and each ignition pin is fashioned likewise to taper pointedly and conically, at its free end facing away from the associated sealing lid section.

20. A cartridge belt magazine according to claim 19, wherein each ignition pin has a sealing lip for sealing and contacting an inner surface of the associated first receiving chamber when the igniter charge has been ignited.

21. A cartridge belt magazine according to claim 19, wherein surfaces of the ignition pin and of the free end of the associated first receiving chamber extend in parallel to each other and are in contact with each other when the ignition pin is placed under pressure.

22. A cartridge belt magazine according to claim 21, wherein a narrow annular zone of each sealing lid section around an end of an associated ignition pin connected therewith is constructed to be flexible in the manner of a film hinge or a diaphragm, permitting an axial movement of the ignition pin in the first mounting chamber.

23. A cartridge belt magazine according to claim 22, wherein the narrow annular zone of each sealing lid section around the associated ignition pin is more thin-walled than a remaining adjacent region of the sealing lid section and ascends toward the end of the associated ignition pin.

24. A cartridge belt magazine according to claim 23, wherein each of the first receiving chambers are slightly increased in cross section at ends on the side of the associated sealing lid section.

25. A cartridge belt magazine according to claim 19, wherein each of the first receiving chambers has a partial chamber adjoining in a region of the conically tapering end, and the igniter charger is introduced in the zone of the conical end as well as in said partial chamber of the first receiving chamber.

26. A cartridge belt magazine according to claim 19, wherein the case member strip comprises a plastic strip with cup-shaped depressions integrally molded thereto and forming the individual case members.

27. A cartridge belt magazine according to claim 26, wherein the plastic strip of the case member strip has thickened marginal borders attached to both longitudinal sides and constructed in the shape of flanges.

28. A cartridge belt magazine according to claim 27, wherein the sealing lid strip is in contact in a clamping and locking fashion with its outer lateral edges with mutually facing inner surfaces of the marginal borders.

29. A cartridge belt magazine according to claim 27 or 28, wherein the two marginal borders extend at one end of the plastic strip away from each other toward the outside.

30. A cartridge belt magazine according to claim 21, wherein each ignition pin has a sealing lip for sealing and contacting an inner surface of the associated first receiving chamber when the igniter charge has been ignited.

31. A cartridge belt magazine made of a synthetic resin, which comprises:

a plastic case member strip comprising several joined-together, open-ended case members for accommodating a propellant charge and an igniter charge for igniting the propellant charge;

a plastic sealing lid strip comprising several joined-together sealing lid sections for sealing the open ends of the case members, respectively, so that the case member strip and the sealing lid strip are coupled with each other; said magazine further comprising:

a plurality of ignition pins movable in an axial direction and integrally joined to a sealing lid section; and in each case member, a first receiving chamber is formed for accommodating an ignition pin and an igniter charge, each of said ignition pins being guided to be longitudinally displaceable in the axial direction in an associated first receiving chamber, and acting, when placed under pressure, on an igniter charge in order to ignite the igniter charge; each ignition pin having a sealing lip for sealing and contacting an inner surface of the associated first receiving chamber when the igniter charge has been ignited.

32. A cartridge belt magazine made of a synthetic resin, which comprises:

a plastic case member strip comprising several joined-together, open-ended case members for accommodating a propellant charge and an igniter charge for igniting the propellant charge;

a plastic sealing lid strip comprising several joined-together sealing lid sections for sealing the open ends of the case members, respectively, so that the case member strip and the sealing lid strip are coupled with each other; said magazine further comprising:

a plurality of ignition pins movable in an axial direction and integrally joined to a sealing lid section; and in each case member, a first receiving chamber is formed for accommodating an ignition pin and an igniter charge, each of said ignition pins being guided to be longitudinally displaceable in the axial direction in an associated first receiving chamber, and acting, when placed under pressure, on an igniter charge in order to ignite the igniter charge; individual sealing lid sections of the sealing lid strip being joined by means of film hinges and the sealing lid strip is arranged at a spacing with respect to the case member strip in the region of the film hinges.

33. A cartridge belt magazine according to claim 32, wherein the sealing lid strip comprises in a zone of the film hinges, respectively, connecting neighboring sealing lid sections, relief openings.

34. A cartridge belt magazine according to claim 33, wherein the relief openings are fashioned as marginal cutouts of the film hinges.

* * * * *